US011643774B2

(12) United States Patent
Dinzinger

(10) Patent No.: US 11,643,774 B2
(45) Date of Patent: May 9, 2023

(54) METHODS FOR THE SEPARATION OF BAOBAB FIBERS

(71) Applicant: HOPE TREE INTERNATIONAL GMBH, Gelting (DE)

(72) Inventor: Lambert Dustin Dinzinger, Gelting (DE)

(73) Assignee: HOPE TREE INTERNATIONAL GMBH, Holzkirchen (DE)

( * ) Notice: Subject to any disclaimer, the term of this patent is extended or adjusted under 35 U.S.C. 154(b) by 176 days.

(21) Appl. No.: 16/954,168

(22) PCT Filed: Dec. 14, 2018

(86) PCT No.: PCT/EP2018/085020
§ 371 (c)(1),
(2) Date: Jun. 15, 2020

(87) PCT Pub. No.: WO2019/115793
PCT Pub. Date: Jun. 20, 2019

(65) Prior Publication Data

US 2021/0156086 A1 May 27, 2021

(30) Foreign Application Priority Data

Dec. 14, 2017 (DE) ..... 10 2017 222 748.6

(51) Int. Cl.

| | |
|---|---|
| ***D21B 1/02*** | (2006.01) |
| ***D21B 1/30*** | (2006.01) |
| ***D21C 1/02*** | (2006.01) |
| ***D21H 11/12*** | (2006.01) |
| ***D21C 3/20*** | (2006.01) |
| ***D21H 23/04*** | (2006.01) |
| ***D01B 1/00*** | (2006.01) |
| *D21H 17/14* | (2006.01) |
| *D21H 17/28* | (2006.01) |

(52) U.S. Cl.
CPC ..... *D21B 1/021* (2013.01); *D01B 1/00* (2013.01); *D21B 1/303* (2013.01); *D21C 1/02* (2013.01); *D21C 3/20* (2013.01); *D21H 11/12* (2013.01); *D21H 23/04* (2013.01); *D21H 17/14* (2013.01); *D21H 17/28* (2013.01)

(58) Field of Classification Search
CPC ..... D21B 1/021; D21B 1/303; D21B 1/02; D21C 1/02; D21C 5/00; D21H 11/12; D21H 17/14; D21H 17/28; D21H 23/04; D01B 1/00
See application file for complete search history.

(56) References Cited

U.S. PATENT DOCUMENTS

| | | | |
|---|---|---|---|
| 800,563 | A | 9/1905 | Geipel et al. |
| 3,726,756 | A | 4/1973 | Polak |
| 6,274,123 | B1 | 8/2001 | Pauly |
| 9,617,417 | B2 | 4/2017 | Avtomonov et al. |

FOREIGN PATENT DOCUMENTS

| | | | | |
|---|---|---|---|---|
| AT | 125453 | B | 11/1931 | |
| AU | 105592 | B | 11/1938 | |
| BE | 1020055 | A5 * | 4/2013 | ..... C04B 18/248 |
| CN | 106109285 | A | 10/2018 | |
| DE | 102006036168 | A1 | 2/2008 | |
| DE | 102009057208 | A1 | 6/2011 | |
| FR | 369657 | A | 1/1907 | |
| GB | 658456 | A | 10/1951 | |
| GB | 2090954 | A | 7/1982 | |
| GB | 190413158 | A | 4/1990 | |
| KR | 20160135245 | A | 12/2010 | |
| WO | WO 2002/014599 | A1 | 2/2002 | |
| WO | WO-2005066396 | A1 * | 7/2005 | ..... D01C 1/02 |
| WO | WO 2006/100560 | A1 | 9/2006 | |
| WO | WO 2015/144893 | A1 | 10/2015 | |

OTHER PUBLICATIONS

Modibbo et al., The effect of moisture imbibition on cellulosic bast fibres as industrial raw materials, 2007, International Journal of Physical Sciences, vol. 2 (7), p. 163-168. (Year: 2007).*

Niang et al., Potential to harness superior nutritional qualities of exotic Baobabs if local adaptation can be conferred through grafting, 2008, Agroforestry Systems. (Year: 2008).*

Silviculture Handbook, Economic Considerations (chapter 62), Apr. 2016. (Year: 2016).*

J. S. Remington et al: The fibre of the baobab tree for paper making. In: Journal of the Franklin Institute, 174, (1912), 5, p. 605.

* cited by examiner

*Primary Examiner* — Anthony Calandra
(74) *Attorney, Agent, or Firm* — Stacey J. Farmer

(57) ABSTRACT

The present invention provides methods for obtaining Baobab fibers derived from Baobab trees. The methods include obtaining Baobab plant material, dewatering of the Baobab plant material, and subsequent separation of the dewatered Baobab plant material. The present invention allows a resource-saving separation of the fibers, for example, through a dewatering of the Baobab plant material. Baobab fibers obtained according to the methods of the present invention can be used for a variety of purposes, for instance, for producing chemical pulp, paper, paperboard, carton, special papers, fabrics and fiber-reinforced plastics.

9 Claims, No Drawings

METHODS FOR THE SEPARATION OF BAOBAB FIBERS

CROSS-REFERENCE TO RELATED APPLICATIONS

This application is a national phase entry under 35 U.S.C. § 371 of International Patent Application PCT/EP2018/085020, filed Dec. 14, 2018, published as International Patent Publication WO 2019/115793 on Jun. 20, 2019, which claims the benefit of German Patent Application DE 10 2017 222 748.6, filed on Dec. 14, 2017, the contents of all are hereby incorporated by reference.

TECHNICAL FIELD OF THE INVENTION

The present invention relates to the field of fiber pulping for obtaining long and short fibers and further to methods for producing baobab fibers using baobab sprouts and young trees as a raw material, as well as baobab fibers obtained therefrom. The invention further relates to the use of the presently disclosed fibers for additional processing into materials including pulp, paper, cardboard, paperboard, specialty papers, fabrics, natural insulation fabrics, lightweight panels and fiber reinforced plastic (matrix polyethylene, PE).

BACKGROUND OF THE INVENTION

In many regions, the fiber industry is closely linked to socio-economic development and a population's standard of living. Because of the rapid economic development and the increase in such standard of living, fiber consumption has increased dramatically. The enormously increasing waste disposal and the associated environmental problems are placing a considerable burden on our planet. The rapid depletion of non-renewable resources has considerably increased the demand for renewable resources. For this reason, there is an urgent need to produce materials derived from natural resources.

Numerous scientists situated around the world have begun to elucidate the potential of natural fibers and their diverse utility. Accordingly, there is a meaningful need for processes directed to natural fiber extraction based on a swift regeneration of raw materials that sustainably reduces damage to the environment. Baobab fibers represent one such attractive alternative, since Baobab trees are easy to cultivate, and there are numerous opportunities to further process the components obtained from the harvesting of Baobob fiber.

The Baobab tree acts as the center of many cultural, economic and social activities of numerous indigenous people. In Africa, for example, the Baobab fruit with its seeds and pulp is a valuable food product. The special importance of the Baobab tree is also illustrated by its designation as a "pharmacist tree", which is based on the wide-ranging medical uses of Baobab-derived materials. For example, the clinical indications of fever, dysentery, smallpox and measles are treated using extracts from Baobob pulp and seeds, also acting as an antidote to injuries caused by poisonous plants of the genus Strophanthus, which are native to many regions throughout Africa. A Baobab tree can also serve as the center of a village as well as the site of local markets and various social events. Further development of a widespread use of the fibers obtained from a Baobab tree could improve the economic situation of the people living in the geographical areas where such Baobab trees are located.

The Baobab tree with its light beige to light brown fibers provides the natural fiber industry with a fiber crop that thrives in a soil type that can be classified as "difficult to grow" and requires comparatively little water and pesticides in addition to providing a positive $CO_2$ balance during cultivation.

Many different soil types are suitable for growing Baobab sprouts and young trees, including sandy loam and laterite. The Baobob trees are usually deeply rooted and provide a firm anchorage that can absorb water and absorb nutrients from a wide area, thus increasing their resistance to drought. In addition, the Baobob tree has no known history of pest outbreaks. The ability to withstand extreme stress from drought and fire allows the Baobob tree to grow where other types of fiber plants would not survive. The Baobab tree is also suitable for marginal land with poor soil quality. Overall, Baobab cultivation provides an advantage of not occupying space otherwise amenable for cultivation of food. Consequently, the use of the Baobab also provides an additional benefit of counteracting world hunger.

Baobob stem and stalks provide usable fibers that can be processed in a number of different ways. An environmentally friendly process makes it possible to transform the production and processing of Baobab fibers into a viable and sustainable industry. Baobab fibers are characterized by high tensile strength and high moisture absorption. Although the long Baobab fibers feel very soft, they are also quite strong and durable. In addition, the light beige Baobab fibers are biodegradable and are not harmful to humans or animals. For these reasons, the Baobab fiber is highly useful as a sustainable resource for a variety of manufacturing and technical applications.

At present, there are numerous retting and separation methods using conventional fiber plants. However, the cultivation of such conventional fiber plants typically occurs on soil otherwise suitable for the potential cultivation of food crops. The conventional fiber plants are typically grown in monocultures and, in order to protect them from pathogens, protective chemicals like pesticides are commonly used, which ultimately pollute the groundwater and can exert additional negative effects on the environment. In addition, these types of plants require a large amount of water to facilitate the cultivation process. Compared to such conventional fiber plants, including sugar cane, bamboo and kenaf, Baobab cultivation requires far less pesticides and water during development. Moreover, Baobab monocultures are also feasible in more infertile areas, where no potential cultivation of food crops is otherwise viable. The cultivation of the Baobab as a renewable crop is thus characterized as environmentally friendly.

Compared to known methods, the pulp processing of Baobab fibers eliminates numerous chemical treatment manufacturing steps. For example, in contrast to other conventional fibers, only small quantities of lignin must be extracted. This particular manufacturing step requires the use of chemicals that are harmful for both the environment and the consumer.

Therefore, there is a need for methods that enable an effective fiber separation of Baobab plant material, a solution provided by the present invention. The Baobab fibers that are produced by the fiber separation processes disclosed herein are distinguished by their increased natural tensile strength. Another important aspect of the present invention is the avoidance of employing environmentally harmful chemicals when removing the lignin component. Notably, Baobab fibers are biodegradable and contain a low proportion of lignin.

SUMMARY OF THE INVENTION

The present invention provides methods for the fiber separation of Baobab plant material for obtaining Baobab fibers.

The process comprises the following steps: a) obtaining the Baobab plant material; b) dewatering the Baobab plant material obtained in step a); and c) separating the dewatered Baobab plant material obtained from step b).

Optionally, a retting of the Baobab plant material from step b) is also carried out between steps b) and c).

Optionally, in an additional step d), a post-treatment of the Baobab fibers from step c), is also performed.

Optionally, between steps b) and c), a retting of the Baobab plant material obtained from steps b) and d), a post-treatment of the separation Baobab fibers from step c), is performed.

In some embodiments, the Baobab plant material obtained in step a) comprises bast and/or stem of a Baobab tree.

In preferred embodiments, in step a) the Baobab plant material is obtained from a Baobab sprout or a young Baobab tree.

In some embodiments, at step a) the Baobab plant material is processed into smaller fragments/wood chips.

In some embodiments, the leaves and bulbs are removed from the Baobab plant material prior to performing step b).

In some embodiments, in step b) the dewatering is performed using a hydraulic press and/or a roller press/bending machine. In a preferred embodiment, in step b) the dewatering is performed using a hydraulic press and a roller press/bending machine. In a particularly preferred embodiment, the hydraulic press and roller press/bending machine are integrated in a single machine.

In some embodiments, a pressure of 500 $N/m^2$ to 200,000 $N/m^2$ is applied on the Baobab plant material in step b).

In some embodiments, the retting between step b) and c) is carried out by a method selected from dew retting/field retting, water retting, and chemical retting. In preferred embodiments, the retting is performed using dew/field retting or water retting.

In some embodiments, in step c), the Baobab plant material is separated by a separation process selected from vapor pressure separation, ultrasound separation, a chemical force separation process, mechanical separation, natural pulping.

In a preferred embodiment, in step c) the Baobab plant material is separated by mechanical separation. In a preferred embodiment, a decorticator machine carries out the mechanical separation. In a further preferred embodiment, the mechanical separation is carried out by a grinding process or by a thermomechanical process (TMP production).

In some embodiments, in step d), the post-treatment comprises dewatering the Baobab fibers obtained by step c).

In some embodiments, the post-treatment in step d) further comprises combing the dewatered Baobab fibers.

In some embodiments, the post-treatment in step d) further includes sorting the combed Baobab fibers.

Long and short fibers can be obtained using the fiber separation methods provided herein. Depending on the process steps used, long fibers or short fibers are preferably obtained, which represents an advantage over conventional methods that do not include such control options.

The methods described herein for obtaining Baobab fibers offer several advantages compared to conventional fiber recovery methods. The dewatering or dehydration step b) provides certain ecological and economic advantages in the subsequent retting and/or separation processes. Dewatering makes fiber separation more effective, which saves time and conserves resources. The superior result provided by the instant retting and separation processes is based on an improved fiber release and on reducing tissue density and tissue integrity during the dewatering step. In addition, the fibers do not suffer any structural damage or shortening when processed using the dewatering processes according to the present invention.

In order to optimize the retting and/or separation processes, the Baobab plant material can be liberated from the leaves and bulbs prior to the dewatering step.

In another aspect, the present invention relates to compositions comprising Baobab fibers obtained by the methods disclosed herein. The compositions are particularly suitable as a starting material for injection molding and compression molding processes. Preferably, the compositions of the present invention comprise Baobab fibers manufactured by methods according to the present invention, and may further comprise magnesium stearate.

In one embodiment, the proportion of Baobab fibers present in the composition is 1-50% of the total dry mass.

In another embodiment, magnesium stearate accounts for 1-20% of the dry mass. In a preferred embodiment, the proportion of Baobab fibers account for 1-50% of the dry mass and the proportion of magnesium stearate accounts for 1-20% of the dry mass. In a particularly preferred embodiment, the proportion of magnesium stearate accounts for 2-10% of the dry mass.

In yet another embodiment, the instant composition further comprises starch and/or preservatives.

DETAILED DESCRIPTION OF THE INVENTION

Definitions

Natural fibers are fibers are derived from natural sources such as plants, animals or minerals and can be used directly without further chemical conversion reactions. Such natural fibers can thus be distinguished from synthetic fibers that are produced through chemical processing.

Fiber matter obtained from plants is referred to herein as fiber material. This term thus encompasses both primary fiber matter, i.e., raw material used for the first time in production, and secondary fiber matter, i.e. recycled materials that are returned to the production processes after their use. The most important fiber matter components are those consisting of cellulose. Lignin is also a fiber matter component. Wood matter such as wood pulp contains large amounts of lignin. In the case of "semi-chemical pulp", the lignin content is reduced so that the cellulose content dominates. "Chemical pulp", on the other hand, consists almost exclusively of cellulose.

Baobab sprout refers to a sprout that is up to 9 weeks old. A young Baobab tree refers to a plant that is older than 9 weeks and up to 7 years old. Young Baobab trees from about 1 to 2 years are preferred for use in the methods disclosed herein. The growth rate is 80 cm to 100 cm per year. Thus, a harvest size of about 80 cm to 200 cm is desired. Baobab trees initially grow without any pronounced diametrical growth, which only begins at a height of 4 to 6 meters.

Types of Fibers

Fibers are distinguished according to the part of the tree from which they are obtained, and further by the methods used to obtain and process them.

Fibers are located in the first part of the bark; these fibers are typically hard and rigid. In contrast, fibers derived from the inner bast, so-called bast fibers, are highly durable and strong and yet soft at the same time. In addition, spongy fibers can be obtained from the soft wood, and are typically soft and long. Finally, fibers can be obtained from the root bark, but these fibers are usually of inferior quality compared to the bark fibers in the first layer. The bast fiber layer offers the highest quality fiber. In order of fiber quality, wood fibers present the best quality, followed by bark fibers and fibers from the bark of the root/bulb.

Long Fibers

Long fibers have a length of over 100 mm. To obtain long fibers, the Baobab trees are preferably harvested as a whole tree, usually followed by retting and mechanical separation. Long fibers are obtained for additional processing into products such as textiles (clothing), fabrics, ropes.

Short Fibers

Short fibers have an average length of 40 to 100 mm. Once obtained, no retting takes place prior to fiber separation. Short fibers are used to make felts or fleeces that are not spun. In addition, molded parts, natural insulation materials, and also geo- and agricultural textiles are produced. The short fibers are also used for the production of fiber-reinforced plastic and in injection molding processes.

Super Short Fibers

Super-short fibers have an average length of only a few millimeters and are mainly used for injection molding processes.

Advantages of the Present Invention

One important aspect of the present invention is that prior to retting/separation, the Baobab plant material is pretreated using a hydraulic press and/or a roller press/bending machine. In contrast to annual plants (e.g. hemp, bamboo) or other tree species, the Baobab tree has a very low lignin content. Specifically, young Baobab trees preferred for use according to the present invention (1-2 years old, 80 cm-200 cm height) as they present lower lignin content than older trees in later growth periods. For this reason, young Baobab trees show little lignification. The application of pressure during the pre-treatment leads to particularly good results using young Baobab trees, since the low lignin content and the associated low lignification permits favorable exposure of the fibers and loosening of plant tissue.

In addition, the sponge-like fibers of the Baobab wood have a very high water content compared to the aforementioned annual plants and other tree species. The high water storage capacity is particularly evident in the stem. The stem contains the largest amount of fibers, the bark-, bast- and wood-fibers. Pre-treatment according to the methods of the invention serves not only to expose the fibers, but also to reduce the overall water content in the plant tissue, which has a positive impact on the results of the following retting and separation processes. For at least these reasons, dewatering during the pre-treatment is more important for Baobab compared to other plants.

Due to the dewatering of the Baobab plant material, the exposure of the fibers and the loosening of the plant tissue, a meaningful reduction in time of between 5-30% is achieved during the subsequent retting and separation processes according to the present invention. Conventional pre-treatments, such as dewatering using heat, require a significantly higher amount of energy during processing. Furthermore, there is no exposure of the fiber and no loosening of the plant tissue.

Methods of the Invention

The methods provided herein relate to fiber separation of Baobab plant material for obtaining Baobab fibers, preferably Baobab plant fibers, which exist as a bundle in the stalks/stem and as bast in the bark. The inner layers of the bark feature tough longitudinal fibers. The wood is fibrous and soft, rots quickly in water, and releases long fibers.

The methods provided herein comprise at least the following steps: a) obtaining Baobab plant material; b) dewatering the Baobab plant material from step a); and c) separating the dewatered Baobab plant material obtained from step b).

Optionally, retting of the Baobab plant material from step b) is performed between steps b) and c).

Optionally, step d) is performed, which is a post-treatment of the separated plant material from step c).

Obtaining Baobab Plant Material, Step a)

The Baobab tree, used for raw material retrieval herein, is also known as the Adansonia tree, and is a genus of large, striking and often bizarrely growing deciduous trees from the subfamily of the cottonwood plants (Bombacoideae), which in turn derive from the mallow family (Malvaceae). The Adansonia trees are widespread in large parts of the African continent, on the island of Madagascar, and in Australia. The Baobab trees used for the production of Baobab plant material herein consist of the species *Adansonia grandidieri, Adansonia madagascariensis, Adansonia perrieri, Adansonia rubrostipa* (*Adansonia fony*), *Adansonia suarezensis, Adansonia za, Adansonia digitata, Adansonia kilima* or *Adansonia gregori* (*Adansonia gibbosa*).

The Baobab plant material can be obtained by pulling the Baobab sprouts/young trees out of the ground by hand or by machine. Leaves and bulbs are preferably removed from the stem. Alternatively, the Baobab sprouts/young trees can be harvested from a combine harvester and processed into smaller fragments ("wood chips").

Dewatering of the Baobab Plant Material, Step b)

The fibers of the Baobab tree can be found under the bark and inside the wood. In order to achieve a better and faster result in retting and/or separation processes, a pre-treatment step including dewatering is employed. In order to optimize the retting process, it is useful to remove leaves and bulbs from the Baobab plant material, which preferably comprises the stem/stalks. The plant material is then dewatered, preferably by being introduced into a hydraulic press and roller press/round bending machine. This step dewaters the Baobab by applying pressure (500 $N/m^2$ to 200,000 $N/m^2$) thereby improving the exposure of the fibers. During the dewatering, a pressure is applied of between 500 $N/m^2$ and 200,000 $N/m^2$, between 1,000 $N/m^2$ and 100,000 $N/m^2$, between 5,000 $N/m^2$ and 50,000 $N/m^2$ or between 10,000 $N/m^2$ and 30,000 $N/m^2$. The dewatering takes place in a time period of between 30 seconds and 1 hour, between 60 seconds and 30 minutes, between 5 minutes and 15 minutes or for 10 minutes. A preferred time period is 30 seconds to 3 minutes.

Preferably, the dewatering step is repeated dewatering several times (1-4 times) in a preferred period of 30 seconds to 3 minutes.

When the plant material is harvested using a combine harvester and processed into wood chips, the dewatering takes place in a hydraulic press.

Dewatering, spreading and exposing the fibers increase the effectiveness of the subsequent retting and separation processes. As a result, higher fiber retrieval can be efficiently achieved in a shorter period of time.

Increased effectiveness also represents an ecological advantage, especially for chemical retting and separation processes, which has the additional positive effect that less additional chemical starting materials are required, and the overall energy consumption is lower.

There is also an additional advantage on vapor pressure separation. Because a small amount of water is already present in the plant material due to the pre-treatment, less energy is required.

Subsequent to the dewatering of the plant material, this process is followed by retting and separation, or directly by separation of the plant material.

Retting of the Baobab plant material between step b) and step c)

The retting prepares the Baobab plant material for the subsequent separation process. During the retting process, pectins are degraded in the stem and a large part of the lignin is removed. Pectins and lignin act as "plant glue", which connects the fibers with the solid wood components of the tree. Removal of these components weakens the cohesion of the fibers, which in turn increases the effectiveness of the subsequent separation process. After retting, the separation step follows, preferably using a mechanical separation process.

Various methods are available for performing the retting process, including dew retting/field retting, water retting, and chemical retting.

Dew Retting/Field Retting

For this retting process, the Baobab sprouts/young trees are pulled out of the ground by hand or by machine. The Baobab sprouts/young trees are then laid out, preferably directly on the ground adjacent to the harvest area. The process takes about 3 to 8 weeks, preferably 4 and 6 weeks or 5 weeks. The formation of dew favors the development of bacteria and microorganisms, which contribute significantly to the degradation of pectins. Thus, the fibers slowly separate from the rest of the plant tissue. The effectiveness of the dew retting can be influenced by various environmental factors.

Water Retting

For this retting process, the Baobab sprouts/young trees are placed on the field after the harvest; in water containers or water ditches, some of which are open. This allows heat transfer obtained from the solar radiation, which accelerates the desired process. The harvested Baobab sprouts/young trees are then placed in warm water at a temperature of 30 to 100° C., preferably 40 to 80° C. or 60° C., for about 3 to 7 days, preferably 4-6 days or 5 days. If cold water (below 30° C.) is used, the duration is two to four weeks, preferably 3 weeks. The retting process can be accelerated by raising the temperature of the water or by adding chemicals or bacteria.

Chemical Retting

Chemical retting is similar to water retting. The plant material is placed in a metal container filled with water. However, in contrast to water retting, heat (20-170° C.) and chemicals are added, e.g. sulfuric acid ($H_2SO_4$) (e.g. 27%), sodium hydroxide (NaOH) or potassium carbonate ($K_2CO_3$) (e.g. 20%). Suitable concentrations of the chemicals are approximately: 27% or 20% of sulfuric acid, 27% or 20% sodium hydroxide and 20% or 18%, for potassium carbonate ($K_2CO_3$).

The mixture is then heated to temperatures of 20 to 170° C., preferably 40 to 80° C., in a particularly preferred embodiment to 60° C. This enables the pectin and lignin to be degraded quickly within a period of approximately 30 minutes to 6 hours. Separation of the Baobab plant material, step c)

During separation, the fibers of the Baobab plant material are separated from other parts of the plant as well as decomposed into individual fiber bundles or fibers.

Various methods are suitable for this separation step (for instance, mechanical pulping/separation, vapor pressure separation, ultrasound separation, chemical force separation). The separation process can be carried out with or without prior retting of the plant material. The retting is not necessary for certain separation processes (vapor pressure separation, ultrasound separation, chemical force separation), while for other separation processes (mechanical separation) retting substantially improves the separation result. This is because mechanical separation processes are not particularly effective in removing the cementing compounds (waxes, hemicelluloses, lignin and hydrocarbons) between fibers.

Mechanical Separation

One preferred separation process is mechanical separation, which is carried out using machinery that mechanically shred the Baobab plant material. A particularly suitable machine is the decorticator; alternatively, a grinding process or a thermodynamic process (TMP production) can be used.

In the case of a semi-automatic mechanical separation, the Baobab fiber is preferably extracted using the decorticator. During the mechanical/separation process in the decorticator, the stems/stalks that were pre-processed by retting are crushed and beaten by a rotating wheel set with blunt knives, such that only fibers remain and the remaining plant mass is detached. In the semi-automatic version of the decorticator, the stems/stalks are inserted by hand and the plant pulp is first scraped from one of the halves of one of the stems/stalks, next the stems/stalks are withdrawn, and then the opposite half is inserted for scraping.

When using a fully automated machine, the entire stem/stalk can be fed into the machine. The Baobab is passed through the mouthpiece, then through the corrugated feed rollers that hold the stems/stalks as they are fed against a stationary rod. At the same time, a stripping drum beats the plant material. The beater bar, the drum diameter, the width and the speed vary depending on the different models. The drum, which scrapes against the blade and is held in place by the beater bar and feed rollers, removes most of the non-fiber plant matter, leaving the fibers slightly roughened and with a slight residual of plant matter remaining on the drum.

Mechanical separation can also use small fragments ("wood chips") as the starting plant material. The wood chips can be ground into fibers (grinding process) by pressing the wood chips into a rotating grindstone. Another variant is to shred the wood chips by means of heat and pressure between two rotating discs. Alternatively, separation of the fibers can be accomplished using a grinder or hammer mill. The separation of the Baobob fibers can also be performed using all suitable conventional methods.

In the so-called refiner process (thermomechanical process), the plant material is first broken down into wood chips and, after additional processing steps, the fibers are separated in the refiner. During this process, the Baobab chips are exposed to temperatures from 70° C. to 140° C., preferably from 90° C. to 120° C. or 100° C. (production of TMP, thermomechanical pulp). The shredding takes place between the edges of the refiner. The fiber bundle dissolves and the lignin is substantially removed.

Vapor Pressure Separation

During this process, the Baobab plant material is treated with alkaline steam at a temperature of 100 to 300° C., preferably 130 to 200° C. or 150° C., in a saturated steam state for a period of 5 to 20 minutes, preferably 10 minutes, using high pressure (1 to 70 bar). This steam treatment step is followed by a rapid drop in pressure, during which the water in the Baobab plant material evaporates. This causes the cell network to disintegrate into individual fibers.

Ultrasound Separation

In this process, the Baobab plant material is placed in an aqueous solution.

Subsequently, the mixture is processed in an ultrasound field. During the process the fibers are purified. Accompanying substances, microorganisms, dyes and odorous substances, and soluble organic residues are largely removed.

Chemical Force Separation

The chemical force separation is similar to chemical retting. However, upon chemical force separation, Baobab chips are used as the starting material, which makes a subsequent process, e.g. a mechanical separation process, redundant. During the chemical force separation process, Baobab chips are placed in a metal container filled with water. Chemicals are supplied, for example potassium carbonate ($K_2CO_3$), sodium sulfide ($Na_2S$), sodium hydroxide (NaOH) and sodium sulfate ($Na_2SO_4$). Suitable concentrations of the chemicals are approximately: 20% or 18% for potassium carbonate ($K_2CO_3$), 27% or 20% for sodium sulfide ($Na_2S$), 27% or 20% for sodium hydroxide (NaOH), 27% or 20% for sodium sulfate ($Na_2SO_4$). The mixture is heated to temperatures from 30 to 170° C., preferably to 40 to 80° C., in a particularly preferred embodiment to 60° C., at a pressure of 7 to 10 bar, preferably 8 bar. This accelerates the degradation of the pectin and lignin within a period of approximately 30 minutes to 6 hours.

Natural Pulping

Natural pulping processes are environmentally friendly processes used to produce pulp, and serve the purpose to produce chemical pulp. In this process, the Baobab wood chips are boiled together with formic acid (biodegradable) and hydrogen peroxide ($H_2O_2$) (aqueous solution>70%), at 30-170° C. for a period of 30 min to 6 hours in a metallic container. Formic acid and hydrogen peroxide solution are preferably present in a ratio of 70% to 30%. In addition, a pressure of 2-10 bar can be applied to accelerate this process. With this treatment, the lignin is largely degraded, thus exposing the fibers. Subsequently, the formic acid can be recovered to about 95-99% by distillation. This process has clear advantages in terms of environmental friendliness compared to chemical retting and chemical force separation. Natural pulping is a preferred method for obtaining short fibers/chemical pulp.

Post-Treatment of the Separated Plant Material, Step d)

Following the separation step, the obtained Baobab fibers are then subjected to a post-treatment step.

The Baobab fibers extracted by the separation process are rinsed. The Baobab fibers are then dried either using mechanical dryers or through sun exposure. Sufficient drying is important since the moisture content in the fiber impacts the fiber quality. Artificial drying leads to better quality fibers than sun drying. Dry fibers are then combed, sorted into different types and packed in bales.

In a preferred embodiment, Baobab pulps that have been produced by chemical force separation are subjected to bleaching, preferably done using a TCF (totally chlorine free) process involving hydrogen peroxide ($H_2O_2$) or ozone. These processes are environmentally friendly. The Baobab pulp is introduced into a bleaching tower up to 25 m high. The desired degree of bleaching is then produced at a temperature of 85° C. to 95° C., preferably 90° C., with the addition of bleaching chemicals. Finally, the bleached Baobab pulp is conveyed by a screw conveyor mechanism.

Properties and Use of the Fibers Obtained

Baobab fibers are light beige (yellow) to brown and are found under the bark (bast fiber), inside the wood of the Baobab tree or in the peel of the fruit of the Baobab tree. The fibers show great strength. They are strong and cylindrical in shape. The fibers are partly spongy and feature a high absorbency. Both the nature of the fibers and the composition can widely vary due to the relevant growing conditions. An exemplary composition of an air-dried wood core Baobab consists of: moisture=10.2%, ash=4.4%, cellulose=52.5%, residual mass=33.9%. The composition of air-dried Baobab bast fiber is: moisture=13.18%, ash=4.2%, cellulose=58.82%, fat and wax=0.41% residual mass=22.87%.

Baobab bast fibers are approximately 80 cm to 140 cm long, 2 mm to 10 mm thick and 10 mm to 50 mm wide. The length of the individual fibers of pulp obtained from Baobab plant material, such as after chemical force separation or natural pulping, is about 2-4.6 mm and about 0.025-0.050 mm wide.

The fiber yield when using retting and subsequent physical separation is 30% to 40% of the total mass of a young Baobab tree.

The methods disclosed herein produce long fibers and/or short fibers. Traditional long fiber separation is mainly used for the production of textiles. In contrast, short fiber technology enables a universal area of application, e.g., pulp production. For the production of long fibers according to the present invention, entire Baobab stems/stalks are harvested, dewatered and, often after retting, separated. For the production of short fibers, in contrast, harvesting by a combine harvester and processing into wood chips is preferred, followed by chemical force separation.

From short Baobab fibers and super-short fibers, obtained by the methods according to the invention, other objects can be produced by injection molding or compression molding. Here, fiber pulp is obtained from Baobab fibers. Subsequently, the pulp is processed using conventional injection molding or compression molding methods known in the art to obtain the desired object. In one exemplary injection molding process, the pulp is mixed with vegetable starch (ratio of Baobab fibers/starch equal to 1:4 to 2:3), water and preservatives in an industrial blender to produce a homogeneous mass. It is particularly advantageous to also add magnesium stearate to this mass. Magnesium stearate acts as a lubricant and makes the cast object easier to remove from the mold. In this case, the resulting mass contains preferably 1-20%, more preferably 2-10% and even more preferably 3-8% magnesium stearate in the dry mass (i.e. mass without water content). An exemplary suitable composition includes 8% Baobab fibers, 86.5% potato starch, 5% magnesium stearate and 0.5% preservatives. This mass is stirred (5 min-120 min) until a viscous consistency is achieved. Then, the homogeneous mass is poured in a viscous form into a downwardly tapering injection unit that contains a rotating screw and a nozzle at the tip. The mass is conveyed by rotating the screw in the direction of the nozzle. The mass builds up in front of the nozzle as it is closed at this point. Since the screw is axially movable, it evades the pressure built up in front of the nozzle and unscrews itself from the mass like a corkscrew. The backward movement is halted by a hydraulic cylinder or electrically, such that a backpressure builds up in the mass. This backpressure in conjunction with the screw rotation dynamically compresses and homogenizes the mass. The screw position is measured continuously, and as soon as a sufficient amount of material for the work piece volume has accumulated, the dosing process is terminated, and the screw rotation is stopped. The screw is also actively or passively relieved, so that the mass is decompressed. In the following injection phase, the injection unit is moved to the clamping unit of the injection mold, pressed with the nozzle and the screw is pressurized on the back. The mass is pressed under high pressure (usually between 500 and 2000 bar) through the open nozzle and the sprue or the sprue system of the injection mold (temperature 180-200° C.) into the shaping cavity of the mold. A non-return valve prevents the mass from flowing back towards the injection unit. By heating the mass, the water content escapes in the form of gas through the holes in the injection mold. The holes can be in different positions depending on the product to be produced. During the injection, an attempt is made to achieve a flow behavior of the mass which is as laminar as possible, that is to say the mass is immediately heated in the mold where it touches the heated wall of the mold and thereby is solidified. The newly injected mass is forced through the injection channel at a high speed. This high injection speed creates a shear rate in the mass, which makes the mass flow more easily. The fine-tuning of the injection phase influences the structure of the surface and the appearance. After the injection, the nozzle is closed and the plasticizing and dosing process for the next work piece can commence in the injection unit. The material in the mold continues to cool until the core, the liquid core of the work piece, has also hardened and reached the final shape. For removal from the mold, the ejector side of the injection mold is opened, the work piece is ejected by pins penetrating into the cavity and either falls down (bulk material) or is removed from the mold by handling devices and placed in an orderly manner or sent for further processing. The sprue must either be removed by separate processing or is automatically cut off during demolding. Sprue-free injection molding is also possible with hot runner systems, in which the sprue system constantly remains above the solidification temperature and the material contained can thus be used for the next injection. Following removal from the mold, the injection mold is again closed and the cycle starts anew. The cycle can take place within 22 seconds.

In an exemplary compression molding process, similar to the injection molding process, a homogeneous mass is formed from Baobab fibers, vegetable starch, water and preservatives. It is also particularly advantageous to also add magnesium stearate to the mass. The mass preferably contains 1-20%, more preferably 2-10% and most preferably 3-8% magnesium stearate in the dry mass (i.e. mass without water content). An exemplary suitable composition comprises 8% Baobab fibers, 83.5% potato starch, 8% magnesium stearate and 0.5% preservatives. Subsequent to mixing, the mass is placed in the heated cavity of a mold. The mold is closed using a pressure piston. The pressure causes the mass to assume the shape given by the mold (cup, bowl, etc.). Here the temperature is used to influence the hardening process of the mass. The water content escapes in the form of gas. After cooling down, the finished product can be removed from the press mold and, if necessary, reworked or further processed (removal of excess material, printing, etc.).

The products obtained by injection molding or compression molding provides the base material (Baobab pulp) with the desired density and stability. Furthermore, the disclosed methods enable a more water-repellent material to be produced. The resultant material remains 100% biodegradable and natural.

The fiber content of the mass is usually 20-40%. In combination with the relatively low temperatures of 180-200° C., higher fiber contents lead to an incomplete filling of the casting or pressing mold or to an uneven fiber distribution. Temperatures above 200° C. commonly result in burnt or other damage to the material. The lower temperatures applied during manufacturing also lead to lower energy consumption, and the cycle times can be shortened.

Injection molding, and in particular other special methods, permit a wide range of shape and surface structures, such as smooth surfaces, grain for touch-friendly areas, patterns, engravings and color effects (food coloring).

One aspect of the invention relates to compositions (also referred to above as "mass") made of Baobab fibers, which are suitable for use in injection molding and compression molding processes. As mentioned above, it is particularly advantageous to add magnesium stearate to these compositions. Magnesium stearate acts as a lubricant and makes the cast object easier to remove from the mold, which, for example prevents damage. The compositions of the present invention preferably contain 1-20%, more preferably 2-10% and most preferably 3-8% magnesium stearate in the dry mass (i.e. mass without water content).

The Baobab fibers in the compositions are obtained by one of the methods described above. The proportion of Baobab fibers is preferably 1-50% of the dry mass, more preferably 2-20% of the dry mass, even more preferably 5-10% of the dry mass. The composition preferably also contains starch. Starch may represent 30-98% of dry mass, preferably 60-97% of dry mass, more preferably 70-90% of dry mass. In addition, preservatives can also be added to increase the durability of the instant compositions. The content of preservatives can be, for example, 0.1-2%, preferably 0.5%. An exemplary suitable composition comprises 8% Baobab fibers, 83.5% potato starch, 8% magnesium stearate and 0.5% preservatives in the dry mass. Table 1 below shows exemplary embodiments of compositions of the present invention. The percentages refer to the dry mass

| COMPOSITION | BAOBAB FIBERS | STARCH | MAGNESIUM STEARATE | PRESERVATIVES |
|---|---|---|---|---|
| 1 | 1-50% | 30-98% | 1-20% | — |
| 2 | 1-50% | 28-97.9% | 1-20% | 0.1-2% |
| 3 | 2-20% | 60-97% | 1-20% | — |
| 4 | 2-20% | 58-96.9% | 1-20% | 0.1-2% |
| 5 | 3-8% | 72-96% | 1-20% | — |
| 6 | 3-8% | 70-95.9% | 1-20% | 0.1-2% |
| 7 | 1-50% | 40-97% | 2-10% | — |
| 8 | 1-50% | 38-96.9% | 2-10% | 0.1-2% |
| 9 | 2-20% | 70-96% | 2-10% | — |
| 10 | 2-20% | 68-95.9% | 2-10% | 0.1-2% |
| 11 | 3-8% | 82-95% | 2-10% | — |
| 12 | 3-8% | 80-94.9% | 2-10% | 0.1-2% |
| 13 | 1-50% | 42-96% | 3-8% | — |
| 14 | 1-50% | 40-95.9% | 3-8% | 0.1-2% |
| 15 | 2-20% | 72-95% | 3-8% | — |
| 16 | 2-20% | 70-94.9% | 3-8% | 0.1-2% |
| 17 | 3-8% | 84-94% | 3-8% | — |
| 18 | 3-8% | 82-93.9% | 3-8% | 0.1-2% |

EXAMPLES

The present invention is illustrated by the following non-limiting examples.

Example 1: Mechanical Fiber Separation Following Dew Retting to Obtain Baobab Fibers (Performed in Huelva, Andalusia, Spain)

Baobab sprouts/young trees were mechanically pulled out of the ground using the Simon RPNC-Leek harvester. The leaves and bulbs were then manually separated from the stalks/stem of the sprouts/young trees with a sharp object (knife). Dewatering was then carried out; for this purpose, the Baobab raw material was inserted into a hydraulic double column press (hydraulic press machine) manufactured by Dieffenbacher, which dewatered the Baobab by applying a pressure of 10,000 N/m$^2$ thereby improving the exposure of the fibers.

Once dewatered, the sprouts/young trees were processed by dew retting. The sprouts/young trees were placed directly on the ground of the harvest. The retting process lasted 2.5 weeks. The formation of dew on and in the plant material led to the development of bacteria and microorganisms, which degrade the pectins in the plant material and slowly detached the fibers from the rest of the plant tissue. The applied pre-treatment (dewatering, fiber exposure) accelerated the pectin degradation during the dew retting process.

The entire stalks/stem were then inserted into a fully automatic decorticator machine from Textile & Composite Pty Ltd. The stems/stalks were fed through the mouthpiece to the feed rollers that held the stems/stalks, while they were fed against a stationary corrugated rod. At the same time, the stripping drum interacted with the plant material. The beater bar, drum diameter, width and speed varied depending on the decorticator model and the nature of the stalks/stems. The drum stripped away most of the non-fiber plant material, leaving the fibers slightly roughened with low levels of non-fiber plant material.

The Baobab fibers were then washed and mechanically dried. Finally, the dry fibers were combed, sorted into different types and packed in bales.

The protocol yielded a fiber content of 30 to 40% of the total mass of a young Baobab tree. The fiber bundles obtained were approximately 80 cm to 140 cm long, 2 mm to 10 mm thick, and 10 mm to 50 mm. The aim of the method was to extract long fibers of the highest possible quality.

Conventional field/dew retting techniques usually require about 3 to 8 weeks. With the innovative pre-treatment (dewatering and fiber exposure) disclosed herein, effective dew retting is completed in a period of about 2 weeks, representing an efficiency of 30%.

Example 2: Mechanical Fiber Separation Subsequent to Water Retting for Obtaining Baobab Fibers (Performed in Huelva, Andalusia, Spain)

Baobab sprouts/young trees were pulled out of the ground mechanically using the Simon RPNC-Leek harvester. The leaves and bulbs were then manually separated from the stem/stalk of the sprouts/young trees using a sharp object (knife). Dewatering was then carried out. For this purpose, the Baobab raw material was inserted into the hydraulic double-column press manufactured by Dieffenbacher (hydraulic press machine), which dewatered the Baobab by applying a pressure of 10,000 N/m$^2$, thereby improving the exposure of the fibers.

Thereafter, the dehydrated Baobab sprouts/young trees were placed in open water containers, thus permitting heat transfer obtained from the solar radiation. The Baobab sprouts/young trees were immersed in warm water at temperatures of around 34° C. for less than 3 days.

The entire stalks/stem were then inserted into a fully automatic decorticator machine produced by Textile & Composite Pty Ltd. The stalks/stems were then fed through the mouthpiece to the feed rollers, which held the stalks/stems while being fed against a corrugated stationary rod. At the same time, the stripping drum beat the plant material. The beater bar, the drum diameter, the width and the speed varied depending on the decorticator model and the nature of the stalks/stems. The drum stripped most of the non-fiber plant material, leaving the fibers slightly roughened and with low levels of non-fiber plant material.

The Baobab fibers were then washed and mechanically dried. Finally, the dry fibers were combed, sorted into different types and packed in bales.

The method produced a fiber content of 30 to 40% of the total mass of a young Baobab tree. The fiber bundles obtained were approximately 80 cm to 140 cm long, 2 mm to 10 mm thick and 10 mm to 50 mm. The aim of the method was to extract long fibers of the highest possible quality.

Conventional water retting techniques require about 3 to 7 days at a temperature over 30° C. At temperatures below 30° C., the duration is typically 2 to 3 weeks. With the innovative pre-treatment (dewatering and fiber exposure) disclosed herein, the water retting at around 30° C. was achieved in less than 3 days. At water temperatures below 30° C., effective retting was achieved in about 1.5 weeks following the novel pre-treatment steps.

Example 3: Chemical Force Separation to Obtain Baobab Fibers

Baobab sprouts/young trees were processed into wood chips directly at harvest using a combine harvester manufactured by Deutz-Fahr Gigant 500. These wood chips were then inserted into a hydraulic double-column press (hydraulic press machine) produced by Dieffenbacher. The hydraulic double-column press dewatered the wood chips by applying a pressure of 10,000 N/m$^2$, thereby improving the exposure of the fibers.

The wood chips were then placed in a metal container filled with water. The following chemicals were added: 15% sodium hydroxide (NaOH), 4% sodium sulfide ($Na_2S$). The amount of the chemicals in percent (%) is related to the mass of the Baobab plant material used. The mixture was heated to a temperature of 90° C., at a pressure of 10 bar, which permitted the pectin and lignin to be rapidly degraded within a period of about 2.5 hours. Due to the previous shredding into wood chips, no further separation process step was necessary.

The pulp produced was then dried, purified and packaged.

This process yielded 50% dry pulp. The dried Baobab plant material used had cellulose content of 53%.

The length of the individual fibers in the pulp obtained from the Baobab plant material was about 2-4.6 mm and the width about 0.025-0.050 mm.

The innovative pre-treatment step (dewatering/fiber exposure) advantageously reduced the amount of required chemicals. Compared to conventional processes, the savings was 5% for sodium hydroxide (NaOH) and 1% for sodium sulfide ($Na_2S$). In addition, the duration of the chemical separation process could be reduced. Conventional methods commonly require up to six hours. Extending the duration of the chemical force separation process following the novel pre-treatment step permitted a savings of the required chemicals by up to 20% compared to the conventional processes.

Example 4: Ultrasound Separation to Obtain Baobab Fibers

Baobab sprouts/young trees were pulled out of the ground mechanically using the Simon RPNC-Leek harvester. The leaves and bulbs were then manually separated from the stem/stalk of the sprouts/young trees using a sharp object (knife). Dewatering was then performed by inserting the Baobab raw material into a hydraulic double-column press (hydraulic press machine) from Dieffenbacher, which dewatered the Baobab by applying a pressure of 10,000 $N/m^2$ to thus improve the exposure of the fibers.

The stem/stalk of the Baobab sprouts/young trees was then placed in an aqueous solution. The solution was processed by an ultrasound field using the ultrasound processor, the Ultrasound UIP16000 from Hielscher. The fibers were thus purified during this process; accompanying residues, microorganisms, dyes and odorous substances and soluble organic components were substantially removed.

Subsequently, the fibers were opened and again purified and dried under heat. The sheaves and short fibers removed in this way can be used as additional products. The fiber-sheaf mixture can be used as a by-product.

Finally, the dry fibers were combed and sorted into different types and packed in bales.

The method yielded a fiber content of 30 to 40% of the total mass of a young Baobab tree. The obtained fiber bundles were approximately 80 cm to 140 cm long, 2 mm to 10 mm thick and 10 mm to 50 mm. The aim of the present method was to obtain long fibers of the highest possible quality.

Compared to methods without a dewatering step, an improved result was achieved herein. By dewatering the plant material and exposing the fibers, the same result was achieved but with a time efficiency of 30%.

Example 5: Vapor Pressure Separation to Obtain Baobab Fibers on a Laboratory Scale Baobab sprouts/young trees were pulled out of the ground mechanically using the Simon RPNC-Leek harvester. The leaves and bulbs were then separated manually from the stem/stalk of the sprouts/young trees using a sharp object (knife). Dewatering was then performed by inserting the Baobab raw material into a roller press round bending machine from Davi, which dewatered the Baobab by applying pressure of 8,000 $N/m^2$ and improved the exposure of the fibers.

The Baobab plant material was then treated with alkaline steam at a temperature of 200° C. in a saturated steam condition using high pressure (50 bar) for a period of 5 minutes, followed by a rapid drop in pressure. During this process, the water in the Baobab plant material evaporated, causing the cellular network to disintegrate into individual fibers.

The fibers were dried, combed, and sorted into different types and packed in bales.

The method yielded a fiber content of 30 to 40% of the total mass of a young Baobab tree. The fiber bundles obtained were approximately 80 cm to 140 cm long, 2 mm to 10 mm thick and 10 mm to 50 mm. The aim was to produce long fibers of the highest possible quality.

Compared to a method without dewatering, the pre-treatment yielded an improved result. Dewatering means that less water must evaporate, so the Baobab plant material had a lower water content. Consequently, 30% less time was required for the same result. A shorter application of the vapor pressure separation also results in considerable energy savings.

Example 6: Natural Pulping to Obtain Baobab Fiber Chemical Pulp

Baobab sprouts/young trees were directly processed into wood chips by the Gigant 500 combine harvester manufactured by Deutz-Fahr. These chips were then used in a hydraulic double-column press (hydraulic press machine) from Dieffenbacher. The hydraulic double-column press dewatered the wood chips by applying a pressure of 10,000 $N/m^2$ to thereby improve the exposure of the fibers.

The Baobab chips were then boiled together with formic acid and hydrogen peroxide ($H_2O_2$) at a temperature of 120° C. for 3 hours in a metal container. A pressure of 7 bar was also applied. The concentrations of formic acid and hydrogen peroxide were 10% and 17% (together 27%) of the mass of the Baobab plant material used. The formic acid could then be recovered to about 97% by distillation. Due to the previous shredding of the Baobab plant material into wood chips, no further separation step was necessary.

The pulp produced was then dried, purified and packed.

The process resulted in a yield of 50% dry pulp. The dewatered Baobab plant material had a cellulose content of 53%.

The length of the individual fibers in the pulp, obtained from the Baobab plant material, was approximately 2-4.6 mm, the width approximately 0.025-0.050 mm.

In comparison to a process without dewatering, the desired result could be achieved with a time efficiency of 15%. In addition, dewatering and exposing the fibers reduced the amount of required chemicals by about 10%.

The invention claimed is:

1. A method for obtaining Baobab fibers, comprising the following steps:

a) obtaining Baobab plant material from a Baobab sprout or a young Baobab tree, b) exposing Baobab fibers present in the Baobab plant material by dewatering the Baobab plant material from step a), wherein the dewatering of the Baobab plant material is performed using a hydraulic press and/or a roller press/round bending machine, and c) separating the dewatered Baobab plant material obtained from step b) to obtain the Baobab fibers, wherein any present leaves and bulbs are removed from the Baobab plant material prior to performing step b).

2. The method of claim 1, wherein additional retting of the dewatered Baobab plant material from step b) is carried out between step b) and step c).

3. The method of claim 1, further comprising step d), post-treating the Baobab fibers obtained from step c).

4. The method of claim 1, wherein in step b), a pressure of 500 $N/m^2$ to 200,000 $N/m^2$ is applied to the Baobab plant material.

5. The method of claim 2, wherein retting is performed by a method selected from dew retting/field retting, water retting, and chemical retting.

6. The method of claim 1, wherein in step c) separation of the Baobab plant material is performed by a method selected from vapor pressure separation, ultrasound separation, chemical force separation, mechanical separation, and natural pulping using formic acid and hydrogen peroxide.

7. The method of claim 3, wherein step d) comprises drying of the Baobab fibers obtained by step c).

8. The method of claim 7, wherein step d) further comprises combing of the dried Baobab fibers.

9. The method of claim 8, wherein step d) further comprises sorting of the combed Baobab fibers.

* * * * *